US006135072A

United States Patent [19]

Kishita

[11] Patent Number: 6,135,072

[45] Date of Patent: Oct. 24, 2000

[54] AIR REGULATED TWO CYCLE ENGINE

[76] Inventor: Toshiji Kishita, 479 Kozawatari-cho, Hamamatsu-Shi, Shizuoka-Ken, Japan

[21] Appl. No.: 09/190,398

[22] Filed: Nov. 11, 1998

[30] Foreign Application Priority Data

Nov. 18, 1997 [JP] Japan ..... 9-356022
Aug. 11, 1998 [JP] Japan ..... 10-239578

[51] Int. Cl.[7] ..... F02B 25/14

[52] U.S. Cl. ..... 123/73 A

[58] Field of Search ..... 123/73 A, 74 AA, 123/73 PP

[56] References Cited

U.S. PATENT DOCUMENTS

| | | | |
|---|---|---|---|
| 3,881,454 | 5/1975 | Jaulmes | 123/73 B |
| 3,905,340 | 9/1975 | Boyesen | 123/73 A |
| 4,000,723 | 1/1977 | Boyesen | 123/73 AA |
| 4,213,431 | 7/1980 | Onishi | 123/73 R |
| 4,461,260 | 7/1984 | Nonaka et al. | 123/478 |
| 4,469,054 | 9/1984 | Onishi et al. | 123/73 R |
| 5,201,288 | 4/1993 | Doragrip | 123/73 DA |

FOREIGN PATENT DOCUMENTS

| | | |
|---|---|---|
| 0337768 | 10/1989 | European Pat. Off. . |
| 3807448 | 11/1989 | Germany . |
| 19520944 | 5/1995 | Germany . |
| 57-183520 | 11/1982 | Japan . |
| 60-11207 | 1/1985 | Japan . |
| 6-193451 | 7/1994 | Japan . |
| 8-49547 | 2/1996 | Japan . |
| 9-125966 | 5/1997 | Japan . |
| 08385 | 9/1915 | United Kingdom . |
| 2022699 | 8/1979 | United Kingdom . |

*Primary Examiner*—Willis R. Wolfe
*Assistant Examiner*—Jason Benton
*Attorney, Agent, or Firm*—Donald E. Schreiber

[57] ABSTRACT

An air regulated two cycle engine is disclosed which is designed to meet with the problems of a conventional two cycle engine, a poor fuel economy, an unsatisfied capability to limit pollution and a failure to produce a desired torque output, arising from the fact that a considerable portion of fuel gas is lost though the exhaust port that remains opened during a compress and admit stroke time interval of the engine. The improved engine is provided with an air intake port that is selectively opened by the piston moving to effect a compress and admit stroke to draw air from an outside atmosphere into the cylinder inside space. The engine that may otherwise be of a conventional design forces air so taken to transfer into the combustion chamber in a fuel transfer stroke time interval and then to regulate an exposition of fuel gas in the combustion chamber so as to maintain fuel gas unburnt therein to lie always in a layer substantially remote from the exhaust port. The piston may be formed in a piston skirt with a slit that provides an air passage between the air intake port and the cylinder inside space. Preferably, the air intake port is provided with an air flow regulating valve that may act to adjust the torque output of the engine, and an air cleaner.

12 Claims, 3 Drawing Sheets

AIR REGULATED TWO CYCLE ENGINE

TECHNICAL FIELD

The present invention relates in general to a two cycle engine, i. e., a reciprocating internal combustion engine that entails two piston strokes or one revolution to complete a cycle, and more particularly to an improvement in such engines, i. e., implemented by an air regulated two cycle engine, hereinafter specifically described.

BACKGROUND ART

A two cycle engine is rather simple in construction and commonly omits various valves as essential in a four (stroke) cycle engine to complete a cycle of operation in a cylinder having a combustion chamber. In the two cycle engine, to accomplish a two stroke cycle of operation, a fuel gas in the form of an air and fuel gaseous mixture is not directly admitted or introduced into the combustion chamber. But, tightly closed, a crank case is associated with a cylinder to accept the fuel gas from a carbureter via a fuel intake port. A reed valve or rotary valve in this port, the only valve that is incorporated in the two cycle engine, is adjusted to control the rate of flow of the fuel gas taken into the crank chamber. The opening and closing actions of the fuel gas intake port as well as an exhaust port for discharging a spent fuel or waste gas and a scavenging port for refreshing a fuel (an air and fuel mixture) from the crank chamber into the combustion chamber in the cylinder, are all governed by the two stroke cyclic movements of a piston in the cylinder.

Thus, the piston, that is slidably received in the cylinder and designed to reciprocate in it between a pair of its dead points, commonly called an upper dead point and a lower dead point, serves to open and close the fuel intake port, the scavenging port and the exhaust port. The piston in the cylinder is typically designed in the form of a dome providing a hollow space with its top side or side adjacent to the combustion chamber closed and its down or opposite side open to the closed space that is defined by the inside of the cylinder and the crank chamber.

In operation of such a conventional two cycle engine, the piston moving from a first dead point in one of the two direction (hereafter called "moving upwards" or "ascending" from its "lower dead point" for the purpose of the brevity of expression) creates a suction or negative pressure in the hollow space therein that causes the fuel intake port to open, permitting a fuel gas (air and fuel mixture) to be sucked or taken into the crank chamber. At the same time the piston ascending in the cylinder also causes a previous fuel (air and fuel mixture) to be compressed in the combustion chamber above the piston in the cylinder.

The piston ascends or continues to move in that one direction until it reaches its second dead point (hereafter "upper dead point") at which point of time the fuel gas compressed in the combustion chamber is explosively fired by the ignition of a spark plug disposed therein to drive the piston to move in the other direction from the second dead point (hereinafter called "descending" or "moving downwards" from its "upper dead point").

The piston descending from its upper dead point first opens the exhaust port to permit a spent fuel or waste gas in the combustion chamber to be instantaneously forced out and discharged therethrough. When the scavenging port is thereafter opened to the combustion chamber or a space above the piston with the piston descending in the cylinder, the refreshing fuel gas (air and fuel mixture) being compressed in the crank chamber is forced to flow from the latter via a scavenging passage and the scavenging port and is admitted into the space now under suction lying above the piston to fill the combustion chamber in the cylinder.

The scavenging port is closed with the piston ascending after it reaches its lower dead point, whereas the exhaust port is allowed to remain open until the fuel gas in the space above the piston or the combustion comber has started to be compressed with the piston before it reaches its upper dead point and until after the scavenging port is closed.

Therefore, with a conventional two cycle engine in which a fuel gas (an air and fuel mixture) is not directly taken in the combustion chamber as in a four cycle engine but its intake and compression must be effected in a single stroke, it has now been observed that the intake, especially of air in the combustion chamber is insufficient and it is because of this that a failure to gain enough torque output of the engine is unavoidable; even an explosive combustion every stroke or cycle cannot yield an output doubling the output which a four cycle engine can normally provide.

Indeed, with the exhaust port held by the piston to remain open until after it has commenced compressing a fuel gas in the combustion chamber, a considerable amount of the fuel gas unburnt is emitted to the environment through this port from the engine over its scavenging and, especially, compression operating time interval. Such a significant loss of fuel in an operation of the traditional two cycle engine has left it of a poor fuel economy, an insufficient gain of torque performance and also deficient in the capability to restrain the environmental pollution.

SUMMARY OF THE INVENTION

It is accordingly an object of the present invention to provide an improved two cycle engine that has an enhanced torque output.

Another object of the present invention is to provide an improved two cycle engine that gives a machine (e. g., a vehicle) equipped therewith a higher operating performance (e. g., traveling performance) than given by the machine equipped with a conventional two cycle engine.

Another object of the present invention is to provide an improved two cycle engine that can avoid a significant loss of a fuel out of its cylinder combustion chamber.

A further object of the present invention to provide an improved two cycle engine that has an enhanced capability to restrain the environmental pollution.

These and other objects are achieved in accordance with the present invention by an air regulated two cycle engine, an improvement in a two cycle engine having a piston slidably received in a cylinder to reciprocate therein between a first and a second dead point, the piston being hollow having its first side closed defining with the cylinder a first space constituting a combustion chamber filled with a fuel gas and its hollow side defined by a piston skirt opening to a second space in the cylinder continuous to a fuel intake chamber wherein the piston moving towards the first dead point to compress the fuel gas in the first space creates a suction in the second space causing a refresh fuel gas from its outside source to flow into the intake chamber and, upon an explosion of the fuel gas in the combustion chamber driving a resultant waste gas instantaneously out though an exhaust port, the piston moving towards the second dead point creates a pressure in the second space to urge the refresh fuel gas to transfer into the first space, the improvement being characterized by an arrangement whereby air is taken from an outside atmosphere into said second space under the suction created therein by said piston moving towards the first dead point and, under the pressure in said second space created by said piston moving towards the second dead point, air so taken is urged to transfer into said first space to force and maintain therein said fuel gas unburnt to lie substantially remote from said exhaust port.

Specifically, the said cylinder is formed through a wall thereof with an air inlet port adapted to be opened and closed with the said piston moving in the said cylinder, the said air inlet port being opened with the said piston skirt to take under the said suction air from the outside atmosphere into the said second space.

Advantageously, the said air inlet port is fully open with the said piston lying at its first dead point.

Advantageously, the said air inlet port is sized and positioned so that the upper end of its opening may become flush with the lower end of the said piston skirt substantially when the piston reaches its upper dead point.

Preferably, the said piston skirt has a slit formed in and through a wall portion thereof facing the said cylinder wall for providing an air passage between the said air intake port and the said second space in the cylinder.

Advantageously, the said slit is oriented longitudinally of the said piston and has a length and a position such that its upper end may come in a region of the opening of the said air inlet port when the piston reaches its lower dead point.

Advantageously, the said slit has a width substantially equal to or narrower than the width or diameter of the opening of the said air inlet port.

Preferably, the said air inlet port is provided with a flow regulating valve for controlling intake of air into the said cylinder. Advatantageously, the said valve is adjustable to cause the said engine to provide an adjustable torque output.

Preferably, the said valve is also provided with an air cleaner for purifying the air taken from the outside atmosphere into the said cylinder.

According to an air regulated two cycle engine with a construction as described and as will further be described specifically hereinafter, it is seen that a loss of fuel is advantageously prevented by air taken from the atmosphere through an air intake port formed at a side surface of the cylinder, the air then layering in the lower region of the inside of the cylinder or within the cylinder chamber always except at an instant at which the fuel mixture gas is exploded and exhausted. Thus, not only is the fuel economy improved, but a possible air pollution to the environment is minimized. Further, eliminating a loss of fuel provides the engine with the ability to gain an enhanced torque output. Also, providing an air flow rate regulating valve with an adjustable opening allows the enhanced torque performance of the engine to be adjusted at a higher or lower level as desired. Further, with a less number of components required, an air regulated two cycle engine according to the present invention can be presented as an engine unit with an excellent performance and yet lighter in weight and less expensive, than a conventional four cycle engine.

BRIEF DESCRIPTION OF THE DRAWINGS

The present invention will better be understood from the following detailed description and the drawings attached hereto showing certain illustrative embodiments of the present invention. In this connection, it should be noted that such embodiments as illustrated in the accompanying drawings hereof are intended in no way to limit the present invention but to facilitate an explanation and understanding thereof.

In the accompanying drawings.

BEST MODES FOR CARRYING OUT THE INVENTION

Hereinafter, a suitable embodiment of the present invention with respect to an air regulated two cycle engine is set out with reference to the figures in the accompanying drawings hereof.

Figure 1:
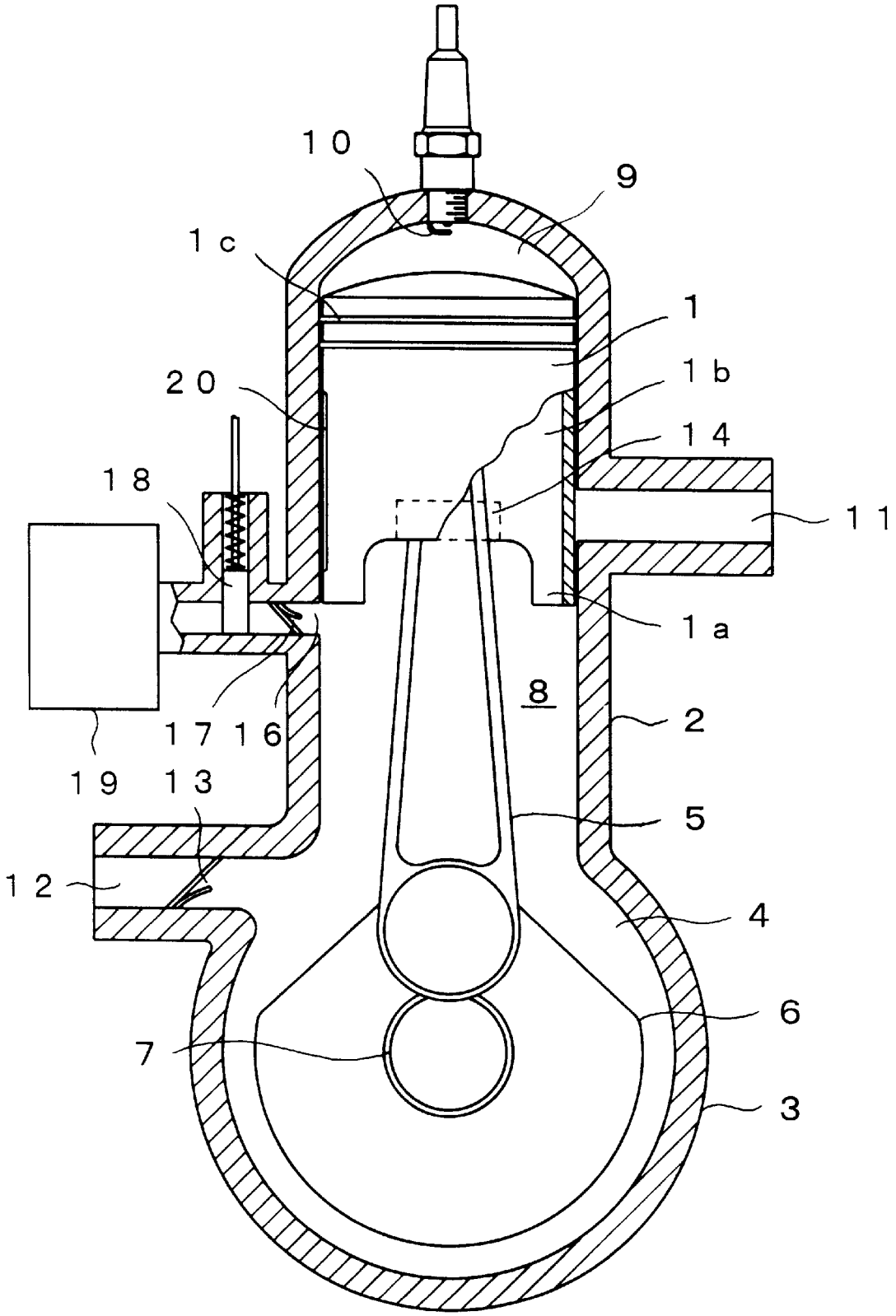
FIG. 1 is a front sectional view that schematically illustrates an air regulated two cycle engine which embodies the present invention.

Referring now to FIG. 1, an air regulated two cycle engine that embodies the present invention is shown to include, as in a conventional two cycle engine design, a piston 1 slidably received in a cylinder 2 and adapted to reciprocate therein. The cylinder 2 as illustrated has a crank case 3 constructed integrally therewith in which a crank chamber 4 is formed. The piston 1 in the cylinder 2 is mechanically coupled and linked via a connecting rod 5 with a crank 6 in the crank chamber 4 so that a reciprocation of the piston 1 may cause a crankshaft 7 of the crank 6 linkage to axially rotate, thus providing a torque output of the engine.

In the cylinder 2 shown here as vertically oriented, the piston 1 with a piston skirt 1*a* is concaved or, as is typical, in the form of a dome to provide a hollow interior 1*b* with its top side closed and its lower side open to a tightly closed space 8, the space that is defined with an inner cylindrical wall of the cylinder 1 and continuous to the crank chamber 4.

To ensure a tight seal with the cylinder wall, the piston 1 also has a piston ring or rings 1*c* fitted thereon.

A space 9 shown above the piston 1 defined with the top inner wall of the cylinder 2 is designed to provide a combustion chamber when the piston 1 reaches its upper dead point as shown. A spark plug 10 is inserted through that top wall of the cylinder 1 to face the combustion chamber 9 and is designed to be ignited to generate a spark to explosively burn a fuel compressed therein. A waste gas that results from the fuel combustion is allowed, when the explosion drives the piston 1 to move downwards from the upper dead point, to flow out instantaneously through an exhaust port 11 that is then opened to the space above the piston 1.

The crank case 3 is provided with a fuel intake port 12 through which the fuel in the form of an air and fuel mixture is admitted from a carbureter (not shown) into the crank chamber 4 towards the inner space 8 of the cylinder 2. A reed valve 13 is provided in the fuel intake port 12 to adjust the rate of flow of the air and fuel mixture admitted therethrough and/or to simply serve as a check valve to prevent the fuel gas admitted into the crank chamber 4 from returning to the carbureter.

Figure 2A:
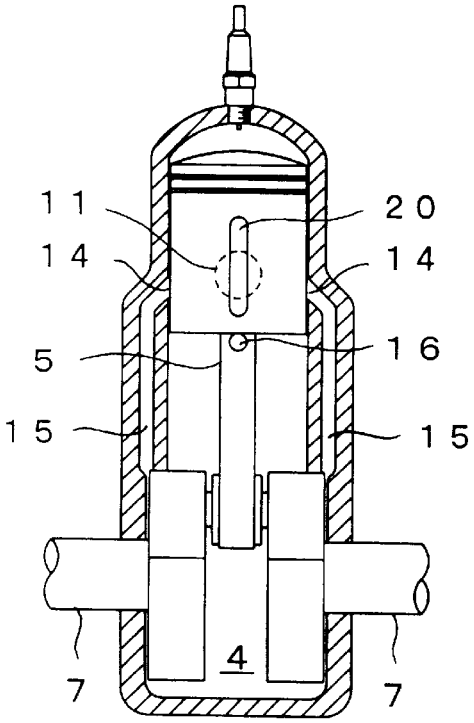
FIG. 2A is a side sectional view diagrammatically illustrating a relationship in position that lies between the piston and the air inlet port when the piston has reached its upper dead point in the air regulated two cycle engine illustrated in FIG. 1.
Figure 2B:
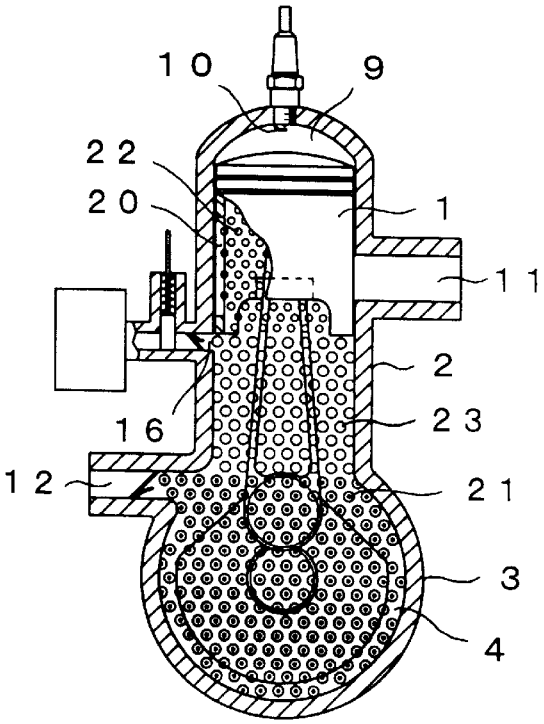
FIG. 2B is a front sectional view diagrammatically illustrating how the air and the fuel gas then distribute.

The cylinder 2 is further provided with a transfer or scavenging port 14, constituted by two as shown in FIGS. 2A, 3A, 4A and 5A, only one of which is shown in FIG. 1, that is opening to the space above the piston 1 while the piston 1 continues to move downwards towards its lower dead point to admit or transfer, through a transfer or scavenging passage 15, the air and fuel mixture being compressed in the crank chamber 4 by the descending piston 1 into the space being reduced in pressure above the descending piston 1 (see also FIG. 2B).

Upon arrival at the lower dead point, the piston 1 moving upwards creates a suction or negative pressure in its hollow space 1*b* which permits a fuel gas (a fresh air and fuel mixture from the carbureter) to be sucked or taken into the crank chamber 4 through the fuel gas intake port 12. At the same time, the piston 1 ascending in the cylinder 2 compresses with it a previous fuel (air and fuel mixture) in the combustion chamber 9. The piston 1 ascends or continues to move upwards until it again reaches the upper dead point at which point of time the fuel gas compressed in the combustion chamber 9 is explosively fired by the ignition of the spark plug 10 to drive the piston 1 again to move downwards.

Figure 3A:
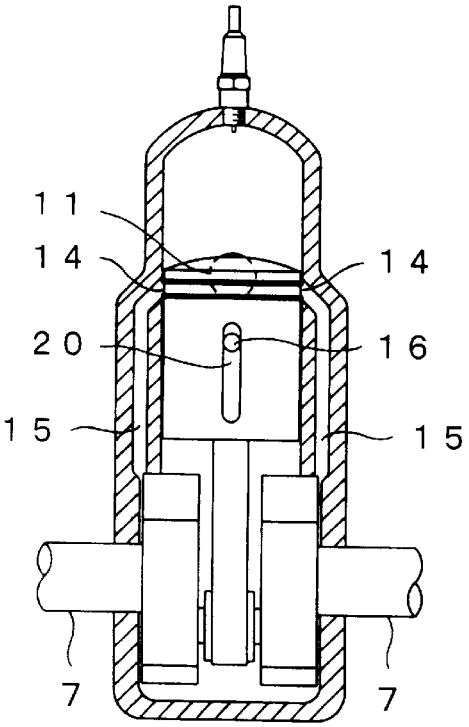
FIG. 3A is a side sectional view diagrammatically illustrating a relationship in position that lies between the piston and the air inlet port when the piston is moving from its upper dead point towards its lower dead point in the air regulated two cycle engine illustrated in FIG. 1.
Figure 3B:
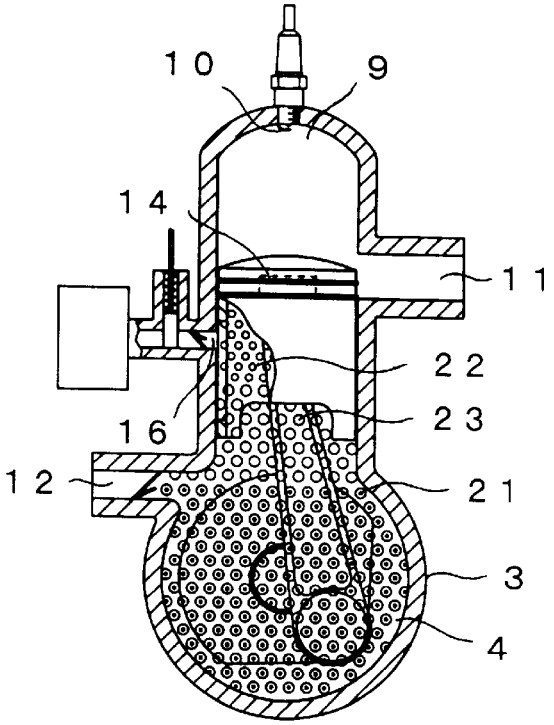
FIG. 3B is a front sectional view diagrammatically illustrating how the air and the fuel gas then distribute.

In the meantime, the scavenging port 14 that was opened is closed with the piston 1, whereas the exhaust port 11 is allowed to remain open until the fuel gas in the space above the piston 1 or the combustion comber 9 has started to be compressed with the piston 1 before it reaches the upper dead point and until after the scavenging port 14 is closed (see also FIG. 3B). As a result, a considerable amount of the fuel gas unburnt (or the fresh air and gas mixture that is admitted into the space above the piston 1 after the waste gas was instantaneously discharged from the combustion chamber) tends to be emitted to the environment through the exhaust port 11 out of the engine in its scavenging and, especially, compression stroke time interval.

This problem is resolved in accordance with the present invention by an arrangement in which air is taken from the environmental atmosphere into the interior 1*b* of the piston 1 or the cylinder inside space 8 above the crank chamber 4 under a suction created therein by the piston 1 ascending towards its upper dead point to compress the air and fuel mixture in the combustion chamber 9 while drawing a refresh fuel (air and fuel mixture) from the carbureter into the crank chamber 4 through the fuel intake port 12, the arrangement replenishing, with air so taken into the space 8, the refresh air and fuel mixture in the crank chamber 4 to be or being furnished into the combustion chamber forming space 9 above the piston 1.

The arrangement in the illustrated embodiment of an air regulated two cycle engine includes an air intake port 16 which acts to draw air from the environmental atmosphere into the space 8 in which a suction is created when the piston 1 is moved to compress the previous air and fuel mixture in the chamber 9. The air intake port 16 typically has a circular opening to the space 8, the opening or the port 15 being preferably located and sized so as to be fully opened to the space 8 with the piston skirt 1*a* at least, or when or before the piston 1 reaches the upper dead point.

The air intake port 16 should in practice be positioned and sized so that the upper end of its opening may become flush with the lower end of the piston skirt 1*a* substantially when the piston 1 reaches the upper dead end.

The air intake port 16 is shown to include a reed valve 17 that serves to prevent air admitted into the space 8 from flowing back to the environment. Also, associated directly therewith, the air intake port 16 preferably has a flow rate regulating valve 18 for adjusting the rate of intake of air into the space 8 through the port 16, and an air cleaner unit 19 that ensures the cleanness of air being admitted into the space 8.

The arrangement in the illustrated embodiment of an air regulated two cycle engine preferably further includes a slit or an elongate opening 20 cut and thereby formed in and through a wall portion of the piston skirt la longitudinally of the piston 1 to assist the intake of air by the port 20 into the space 8 by providing an air passage between the air intake port 16 and the space 1*b* inside of the piston 1 that is continuous to the space 8 in the cylinder 2. The slit or elongate opening 20 should have a width substantially equal to or narrower than the width or diameter of the opening of the air intake port 16. The slit 20 should in practice have a length and position such that its upper end may come in a region of the opening of the air intake port 16 when the piston 1 reaches its lower dead point.

Reference is now made to FIGS. 2A through 5B for the explanation of an operation of an air regulated two cycle engine embodied in the form illustrated and described. FIGS. 2A, 3A, 4A and 5A diagrammatically show, in side sectional views, relationships in position that lie between the piston 1 and the air intake port 16 when the piston 1 has reached the upper dead point, when it is descending, when it reaches the lower dead point and when it is ascending, respectively. FIGS. 2B, 3B, 4B and 5B diagrammatically illustrate, each in a front sectional view, how the fuel gas (i. e., in the form of an air and fuel mixture) admitted through the fuel intake port 12 and air introduced through the air intake port 16 exist and behave in the states shown in FIGS. 2A, 3A, 4A and 5A, respectively.

Figure 4A:
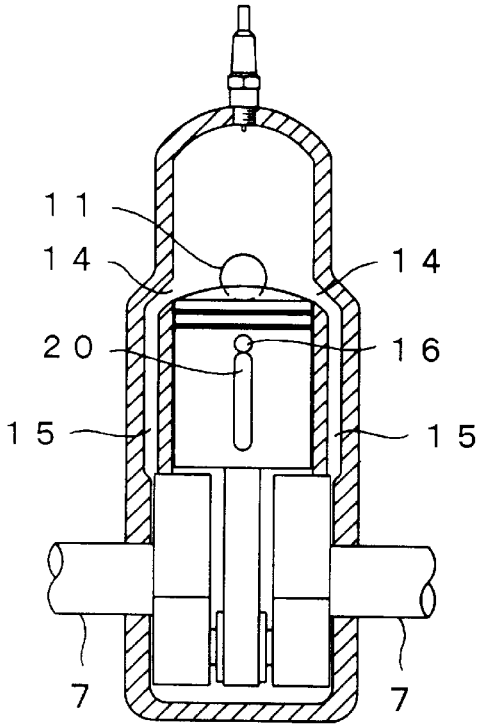
FIG. 4A is a side sectional view diagrammatically illustrating a relationship in position that lies between the piston and the air inlet port when the piston has reached its lower dead point in the air regulated two cycle engine illustrated in FIG. 1.
Figure 4B:
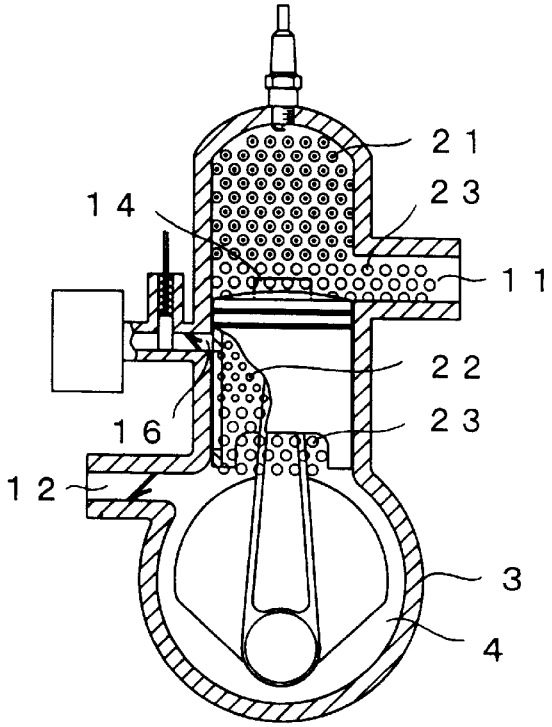
FIG. 4B is a front sectional view diagrammatically illustrating how the air and the fuel gas then distribute.
Figure 5A:
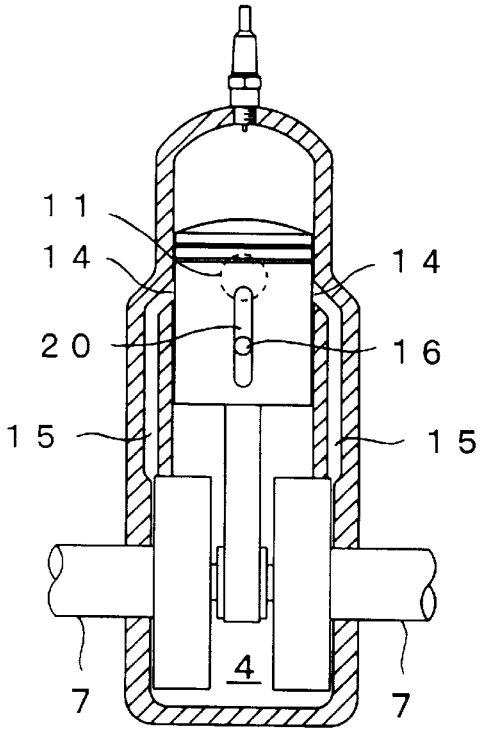
FIG. 5A is a side sectional view diagrammatically illustrating a relationship in position that lies between the piston and the air inlet port when the piston is moving from its lower dead point towards its upper dead point in the air regulated two cycle engine illustrated in FIG. 1.
Figure 5B:
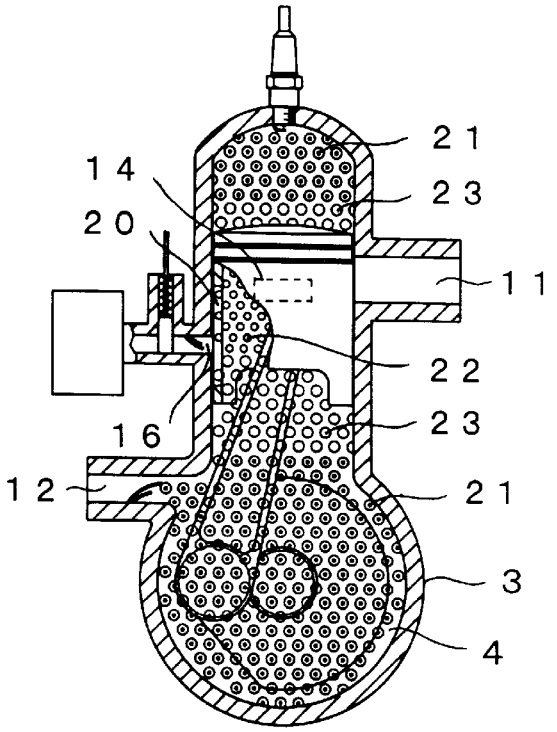
FIG. 5B is a front sectional view diagrammatically illustrating how the air and the fuel gas then distribute.

In each reciprocating cycle, when the piston 1 that has been at the lower dead point as shown in FIGS. 4A and 4B commences ascending as shown in FIGS. 5A and 5B, a negative pressure or suction develops in the piston interior 1*b*, the cylinder inside space 8 and the crank chamber 4 which are continuous, and causes the fuel gas designated by reference numeral 21 to be taken from the carbureter to fill the crank chamber 4. Then, the piston interior 1*b* being placed in fluid communication with the air intake port 16 through the slit 2, air designated by reference numeral 22 is taken from the environmental atmosphere to fill the piston interior 1*b* successively from its upside to its downside as the piston 1 ascends. An intermediate zone which the cylinder inside space 8 occupies between the piston interior 1*b*, upper and the crank chamber 4, lower is shown as filled with a layer of previous air (i. e., the air already taken through the piston interior 1*b* in the previous stroke cycle) designated by reference numeral 23. The scavenging port 14 that has been open is closed immediately after the piston 1 starts ascending to compress the fuel gas 21 in the space 9 above the piston 1.

Thereafter, after arriving at the upper dead point (FIGS. 2A and 2B), when the piston 1 is driven to move downwards as the result of an explosion of the fuel gas, a waste gas is flushed out and discharged instantaneously through the exhaust port 11 FIGS. (3A and 3B). Thence, when the scavenging port 14 is opened with the piston 1 further descending, the fresh fuel gas (air and fuel mixture) 21 in the crank chamber 4 is admitted therethrough under pressure into the space 9 above the piston 1 past the scavenging passage 15. Then, to follow the fuel gas 21 the previously taken air 23 that was stored in the cylinder inside space 8 above that fuel gas 21 in the crank chamber 4 is led under pressure and supplied into the space 9 above the piston 1.

Since the previous air 23 must follow the fuel gas 21 in reaching the space 9, it will be seen that the space 9 constituting the combustion chamber must be filled with an upper layer of the fuel gas 21 and a lower layer of the air 23 as divided from each other as shown in FIGS. 4B and 5B while the exhaust port 11 still remains open to the space 9.

The previous air 23 occupying the lower side of the space or chamber 9 prevents the fuel gas 21 from being exhausted when the piston 1 is moving upwards to commence compressing the chamber 9 inside. The process stages shown in FIGS. 2B to 5B and described above successively taking place and repeated provides an operation in which the fresh air 22 that was taken from the environmental atmosphere while the fuel gas 21 in the space 9 was being compressed is introduced into it as the previous air 23 when that fuel gas is scavenged. Thus, since a layer of air 23 always prevails in the lower zone of the space or chamber 9 except at an instant at which the fuel gas 21 is explosively burnt and exhausted, such a significant loss of fuel as met with a conventional two cycle engine is effectively prevented.

A full combustion of fuel in the chamber 9 that thus results permits a fully enhanced output torque to be obtained and hence a highly improved torque performance to be attained, a significant advantage achieved with the air regulated two cycle engine described.

Furthermore, not only is the fuel economy also improved here but the provision of no opening other than the exhaust port 11 that permits the mixture gas fuel to exit or leak limits air pollution in the environment to a very minimum. To state more for the arrangement, it may be noted that the amount of air intake from the atmosphere with the air intake port 16 can readily be adjusted by an opening of the air flow rate regulating valve 18.

EXAMPLE

Traveling tests were carried out of two motorbikes of an identical small 50 cc capacity equipped, respectively, with a conventional two cycle engine and an air regulated two cycle engine with a feature described above according to the present invention and both run at a constant speed of 30 Km per hour. It was found that the amount of carbon monoxide (CO) contained in the waste gas emitted from the bike with the present air regulated two cycle engine was reduced to ⅛ in average of that from the bike with the conventional two cycle engine. Also, the HC (hydrocarbon) concentration was reduced to ⅓. It was further shown that with a gasoline of 100 cc consumed, the bike with the air regulated two cycle engine was measured to travel 6.5 Km in average, compared with 4.2 Km traveled in average by the bike with the conventional two cycle engine. From these test results it is thus seen how far the present air regulated two cycle engine excels the conventional two cycle engine.

While the present invention has hereinbefore been set forth with respect to a certain illustrative embodiment thereof, it will readily be appreciated by a person skilled in the art to be obvious that many alterations thereof, omissions therefrom and additions thereto can be made without departing from the essence and the scope of the present invention. Accordingly, it should be understood that the invention is not intended to be limited to the specific embodiments thereof set out above, but to include all possible embodiments thereof that can be made within the scope with respect to the features specifically set forth in the appended claims and encompasses all the equivalents thereof.

What is claimed is:

1. A two cycle engine having a piston slidably received in a cylinder to reciprocate between a fires and a second dead point therein, the piston having its first side closed defining with the cylinder a first space constituting a combustion chamber filled with fuel gas and its second side open defined by a piston skirt with a hollow inside space open to a second space in the cylinder continuous to a fuel gas intake chamber, wherein the piston moving towards the first dead point to compress fuel gas in the first space creates suction in the second space drawing fuel gas from an outside source into the intake chamber and, upon an explosion of fuel gas in the combustion chamber driving a resultant waste gas instantaneously out through an exhaust port, the piston moving towards the second dead point creates pressure in the second space that urges fuel gas therein to transfer into the first space, characterized by an arrangement whereby under suction created in said second space by said piston moving towards the first dead point, air is taken from an outside atmosphere into the hollow inside spaced of said Piston skirt and admitted into said second space independently of fuel gas drawn into said fuel gas intake chamber and, under pressure in said second space created by said piston moving towards the second dead point, air so taken and admitted is urged to transfer, behind fuel gas drawn and transferring as aforesaid, into said first space to form an air layer therein which acts in said in said first space to force and hold the fuel gas unburnt being compressed therein to lie as another layer substantially remote from said exhaust port.

2. A two cycle engine as set forth in claim 1 in which said cylinder is formed through a wall thereof with an air inlet port adapted to be opened and closed with said piston moving in said cylinder, said air inlet port being opened with said piston skirt to take under said suction air from the outside atmosphere into the hollow inside space of said piston skirt and said second space.

3. A two cycle engine as set forth in claim 2 in which said air inlet port is fully opened when said piston reaches its first dead point.

4. A two cycle engine as set forth in claim 3 in which said air inlet port is positioned and sized so that the upper end of its opening may become substantially flush with the lower end of said piston skirt substantially when the piston reaches its upper dead point.

5. A two cycle engine as set forth in claim 2 in which said piston skirt has a slit formed in and through a wall portion thereof facing said cylinder wall for providing an air passage or communication between said air intake port and said hollow inside space of the piston skirt.

6. A two cycle engine as set forth in claim 5 in which said slit is oriented longitudinally of said piston and has a length and a position such that said air communication remains established between said air inlet port and the hollow inside space of said piston skirt for a substantial period of time in which said piston is moving from its second dead point to its first dead point, thus providing suction in said second space.

7. A two cycle engine as set forth in claim 5 in which said slit has a width substantially equal to or narrower than the width or diameter of the opening of said air inlet port.

8. A two cycle engine as set forth in claim 2 or 5 in which said air inlet port is provided with a flow regulating valve for controlling intake of air into said hollow inside space of the Piston skirt and said second space in the cylinder.

9. A two cycle engine as set forth in claim 8 in which said valve is adjustable to cause said engine to provide an adjustable torque output.

10. A two cycle engine as set forth in claim 5 in which said air inlet port is provided with an air cleaner for purifying air taken from the outside atmosphere into said hollow inside space of the piston skirt and said second space in the cylinder.

11. A two cycle engine comprising a cylinder (2), a piston (1) having a hollow inside space **(1*b*) defined by a piston skirt (1*a*) and movable in the cylinder (2) and a crank chamber (4) wherein fuel gas in the form of air and fuel mixture is drawn from a carburetor through a fuel gas inlet port (12) into the crank chamber (4) under suction created therein, characterized in that the cylinder (2) is laterally formed with an air inlet port (16) for drawing air therethrough into said inside space (1*b*) of the piston (1) under suction created in said crank chamber (4), and said piston (1) has a slit (20) formed in said piston skirt (1*b*) to extend longitudinally thereof for providing communication between said air inlet port (16) and the inside space (1*b*) of said piston (1) to suck and admit air into said piston inside space (1*b*) for a period substantially in which the piston (1) is in its ascending stroke, and that for a period in which the piston (1) is in its fuel gas transfer stroke, air drawn into said inside space is forced by said piston (1) to transfer, behind fuel gas transferring, into a combustion chamber (9) in said cylinder (1) to form an air layer (23) therein which acts in said combustion chamber (9) to force the fuel gas unburnt being compressed therein to lie as another layer substantially remote from an exhaust port (11)**.

12. A two cycle engine as set forth in claim 11, further comprising a reed valve (17), an air flow rate control valve (18) and an air cleaner (12) ahead of said air inlet port (16).

* * * * *